US005243159A

United States Patent [19]

Demissy

[11] Patent Number: 5,243,159

[45] Date of Patent: Sep. 7, 1993

[54] SECTION OR DISCONNECT SWITCH WITH AN INTERRUPTER SWITCH OPERATED BY THE UPWARD MOVEMENT OF THE DISCONNECT SWITCH BLADE

[75] Inventor: Daniel Demissy, Montreal, Canada

[73] Assignee: GEC Alsthom Energie Inc., Laprairie, Canada

[21] Appl. No.: 863,223

[22] Filed: Apr. 3, 1992

[30] Foreign Application Priority Data

Apr. 10, 1991 [FR] France ..... 91 04346

[51] Int. Cl.[5] ..... H01H 9/38; H01H 33/12

[52] U.S. Cl. ..... 200/146 R; 200/48 R

[58] Field of Search ..... 200/146 R, 48 R, 48 A, 200/48 KB

[56] References Cited

U.S. PATENT DOCUMENTS

| | | | |
|---|---|---|---|
| 2,824,936 | 2/1958 | Huttinger | 200/146 R |
| 2,897,323 | 7/1959 | Krase et al. | 200/146 R |
| 3,171,004 | 2/1965 | Luehring | 200/146 R |

FOREIGN PATENT DOCUMENTS 1156919 7/1969 United Kingdom .

*Primary Examiner*—J. R. Scott

*Attorney, Agent, or Firm*—Sughrue, Mion, Zinn, Macpeak & Seas

[57] ABSTRACT

A section switch of the type has a blade connected at a first end to a first connector. The blade is enabled during an opening stage, firstly to rotate about its own axis and secondly to pivot about a transverse axis. The blade includes at a second end, a contact hammer for co-operating with jaws connected to a second connector. The section switch also includes a mechanism such that during an opening operation, once the blade has rotated about its own axis with disconnection of the hammer electrically from the jaws, electricity is initially diverted through and is subsequently switched by an interrupter switch. The interrupter switch opens under the control of a sudden break drive mechanism controlled by the displacement of the blade. The section switch includes two horns between which a sacrificial hammer moves with friction.

5 Claims, 6 Drawing Sheets

SECTION OR DISCONNECT SWITCH WITH AN INTERRUPTER SWITCH OPERATED BY THE UPWARD MOVEMENT OF THE DISCONNECT SWITCH BLADE

The present invention relates to a section switch, and more particularly it relates to a section switch that opens vertically.

BACKGROUND OF THE INVENTION

Section switches have little or no circuit-breaking ability. Nevertheless, it is desirable for section switches to have some circuit-breaking ability, in order to perform certain loop transfer operations.

An object of the present invention is to provide a section switch with considerable circuit-breaking ability, e.g. enabling 4200 A at 20 kV phase-to-ground to be interrupted.

Another object of the invention is to provide a section switch capable of operating safely even if ice has formed on the apparatus, without penalizing the cost price of the apparatus by providing an overdimensioned drive mechanism.

U.S. Pat. No. 2 897 323 describes an apparatus combining a section switch and a circuit breaker, in which, on opening, current is deflected via an arcing horn that cooperates with a small wheel. That apparatus cannot operate when ice has formed on the arcing horn and on the wheel since the mechanism operates in compression. A much higher force is required to break ice in compression.

Another object of the invention is to provide a section switch in which ice is broken without using a large force.

U.S. Pat. No. 2 824 936 proposes placing the blade of a section switch in such a manner that contact with the arcing horn takes place laterally. The Applicant has observed that if a large force is exerted on the blade to break the ice, then the blade bends sideways, particularly if the blade is long. The use of such apparatus is thus to be avoided, particularly in high tension applications which require a long blade in order to provide isolation.

Another object of the invention is to provide a high tension apparatus that includes a blade of sufficient length to provide isolation and in which ice is broken both on opening and on closing without any danger of damaging the blade.

SUMMARY OF THE INVENTION

All the above objects are achieved by the invention which provides a section switch of the type comprising a blade connected at a first end to a first connector and to means enabling it during an opening stage firstly to rotate about its own axis and secondly to pivot about a transverse axis, said blade including at its second end a contact hammer for cooperating with jaws connected to a second connector, the section switch including means such that during an opening operation, once the blade has rotated about its own axis to disconnect the hammer electrically from the jaw, electricity is initially diverted through and is subsequently switched by an interrupter switch, which switch opens under the control of a sudden break mechanism controlled by the displacement of the blade, wherein said means comprise a sacrificial hammer removably disposed to extend the hammer and co-operating with two horns between which it engages and moves with friction, one of the horns having an insulating portion between two metal portions, one of which is connected to the second connector and the other of which is connected to one of the inlets of the interrupter switch, the other horn having an insulating portion lying between two metal portions, one of which metal portions is connected to the second connector, the sacrificial hammer being suitable, during an opening operation, for moving an arm that controls the operation of the drive mechanism for the interrupter switch, the insulating portions of the horns being offset to enable current to be switched from the sacrificial hammer to the interrupter switch, with the second terminal thereof being connected to the second connector.

In a particular embodiment, the drive mechanism for the section switch comprises a first lever that pivots under drive from the arm about a fixed axis disposed at a first end thereof, a spring fixed firstly to the second end of said first lever and secondly to a first end of a second lever pivotally mounted about a fixed axis placed at its second end, said second lever carrying a stud that is engaged in an oblong slot in a part that is connected to the moving contact of the interrupter switch.

Advantageously, the mechanism includes first and second abutments limiting the stroke of said second lever.

The axis of the first lever includes a stud for preventing the spring from passing beyond said axis.

BRIEF DESCRIPTION OF THE DRAWINGS

An embodiment of the invention is described by way of example with reference to the accompanying drawings, in which.

DETAILED DESCRIPTION

Figure 1:
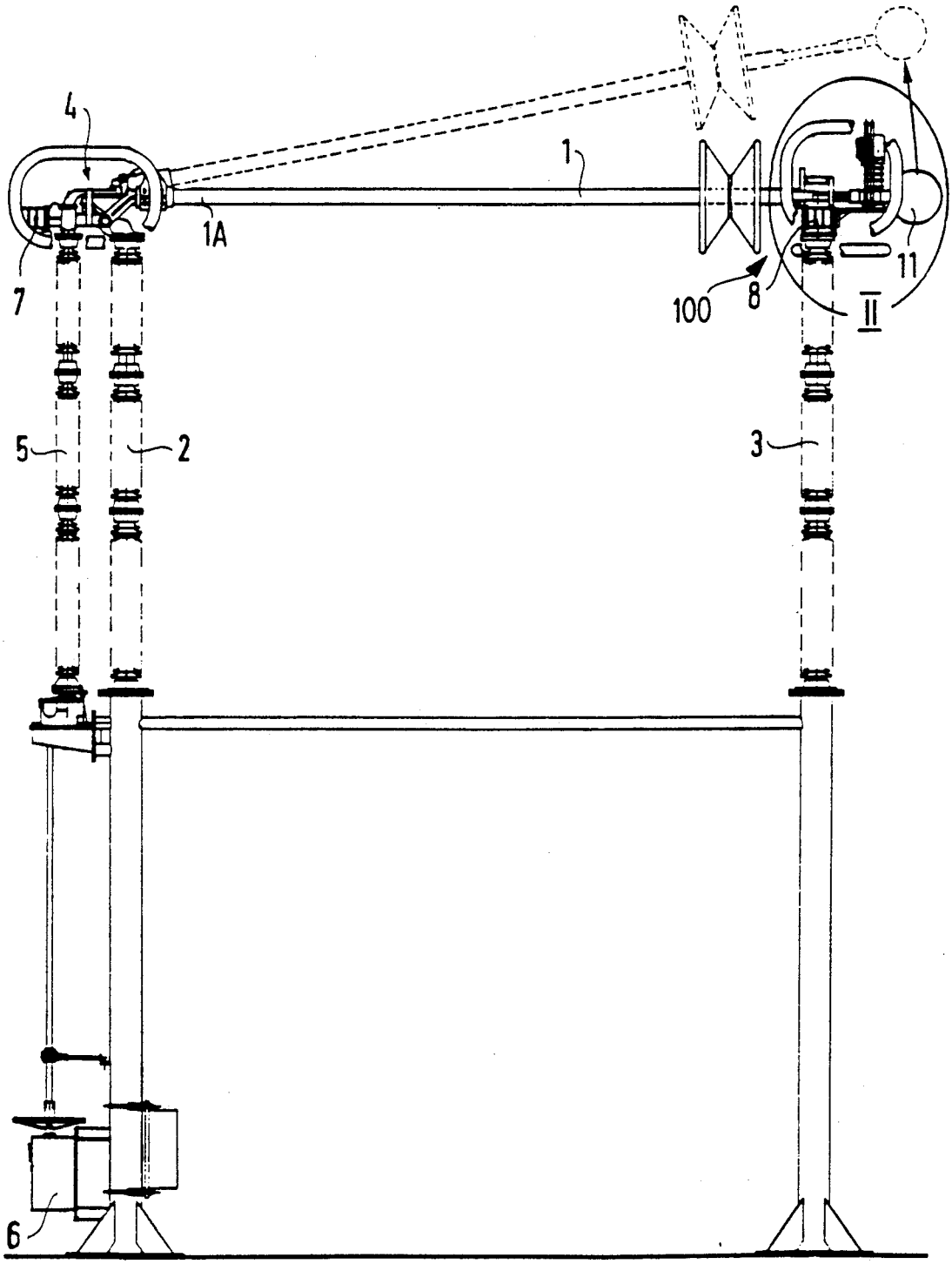
FIG. 1 is an elevation view of a section switch of the invention.

In FIG. 1, reference 1 designates a sectioning blade 1 of a section switch indicated generally at 100, the blade 1 being hinged at a first end to the top of a first column 2 and carrying a contact hammer 10 at its second end for co-operating with jaws 9 placed at the top of a second column 3. The hammer is elongate in section such that in a given position it comes into tight contact with the jaws, while after rotating through 90° about its longitudinal axis, it looses contact with the jaws 9.

The drive mechanism, given overall reference 4, enables a column 5 that is rotated by a motor 6 to cause the blade 1 starting from a closed position of the section switch, firstly to rotate about its own axis so as to release contact between the hammer 10 and the jaws 9, and then to pivot in a vertical plane. This mechanism is well known and since it does not relate directly to the invention, it is not described in greater detail. It is merely observed that the rotation of the blade about its own axis generally takes place through 90°, and that that is the value of rotation assumed below.

The first end 1A of the blade 1 is electrically connected to a first connector 7. The jaws 9 are connected to a second connector 8.

Figure 2:
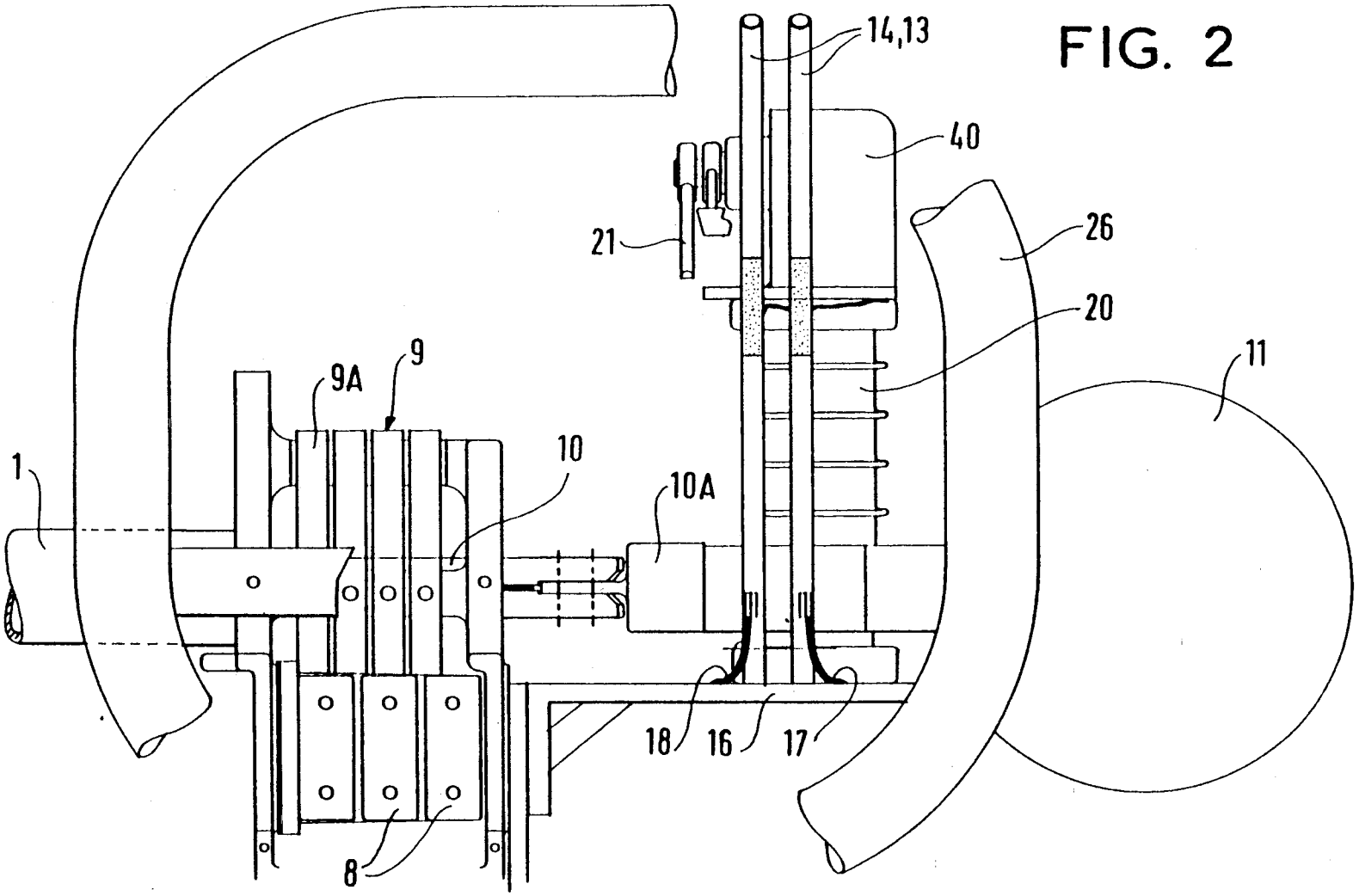
FIG. 2 is an elevation view on a larger scale of the top of the second support column of the section switch.

FIG. 2 shows the jaws 9 in greater detail, comprising a plurality of contact fingers 9A with the hammer 10 at the end of the blade 1 being extended by a sacrificial hammer 10A which is consumable and which is consequently fixed to the hammer 10 in removable manner to facilitate replacement thereof. The sacrificial hammer 9A carries an anticorona ball 11.

The contact fingers 9A are connected to the connector 8.

The cylindrically shaped sacrificial hammer engages between two horns 13 and 14 in the form of rods, each having a rectilinear portion and a curved portion. The horns are electrically connected to the connector at one end each. The horns are spaced apart so that both of them remain in contact with the sacrificial hammer 10A during an opening operation until the sacrificial hammer 10A has gone past the curved portions of the horn. A spring 15 between the horns serves to apply sufficient pressure. The horns are fixed to a metal bracket 16 which is itself mechanically and electrically connected to the connector 8.

The base of each horn 13 includes a conducting portion 13A and an insulating portion 13B adjacent to the portion 13A, followed by a metal portion 13C.

The base of each horn 14 includes a conducting portion 14A in electrical connection with the bracket 16 via braids 17 and 18 followed by an insulating portion 14B and an insulating portion 14C. The portions 13B and 14B may be made of Teflon (registered trademark) for example, which is insulating and which withstands the switching arc. The portions 14C are preferably made of epoxy resin, which is an insulating material that is cheaper than Teflon.

An interrupter switch 20 is fixed on the bracket 16, and is preferably of the type having a vacuum switch 20A whose opening is controlled by a trigger arm 21 actuated by the displacement of the sacrificial hammer 10A.

The bottom terminal of the interrupter switch 20 is electrically connected to the bracket 16 and its other terminal is electrically connected to the portion 13C of the horn 13 via braids 22 and 23.

Reference numerals 25 and 26 designate anticorona rings.

Figure 4:
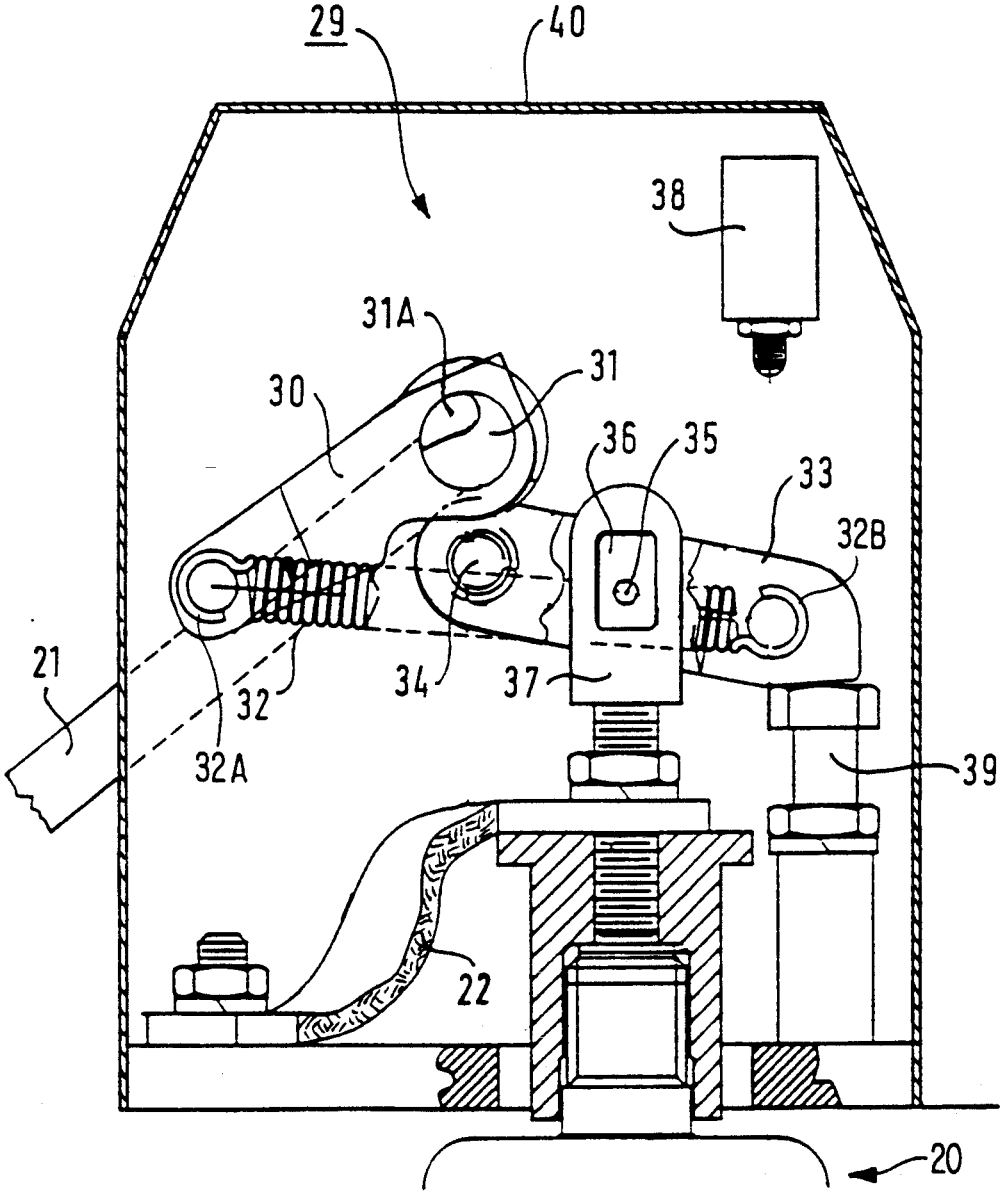
FIGS. 4 to 6 are views in various different operating positions of the section switch showing the mechanism for driving the interrupter switch with which the section switch is provided.
Figure 5:
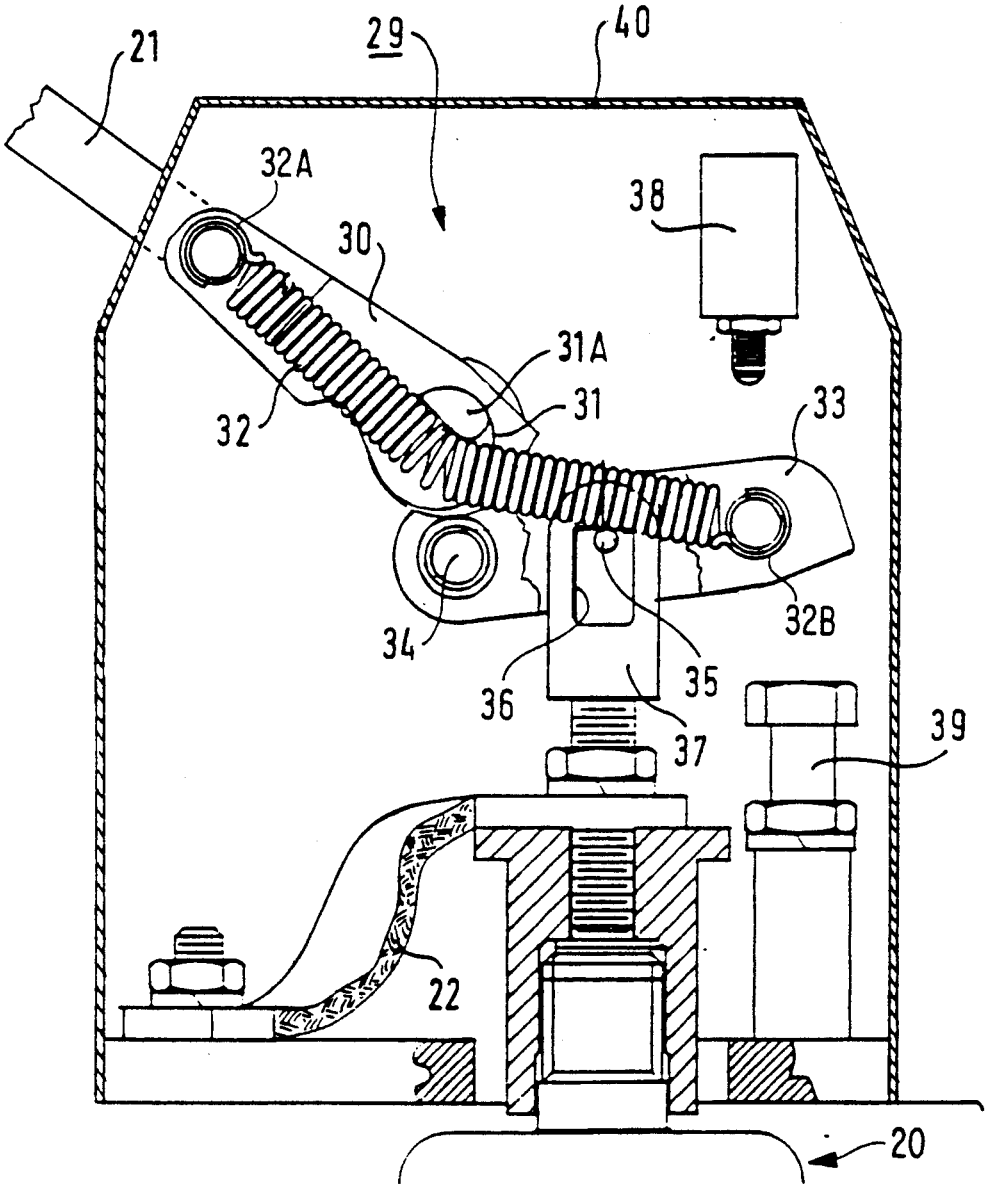

The interrupter switch sudden break mechanism drive given an overall reference numeral 29 is now described with reference to FIGS. 4 to 6.

The trigger arm 21 is extended by a first lever 30 that pivots about a fixed axis 31 situated at one of its ends. A shaft on the axis 31 carries a stud 31A. The first end of a spring 32 is fixed to the other end 32A of the lever 30, and the other end 32B of the spring is fixed to a first end of a second lever 33 that pivots about a fixed axis 34. The lever 33 carries a stud 35 that engages in an oblong slot 36 in a part 37 that is secured to the moving contact of the vacuum switch.

Reference numerals 38 and 39 designate abutments for limiting the stroke of the lever 33.

The sudden break drive mechanism 29 is placed in a cover 40 with the trigger arm 21 passing therethrough.

Figure 3:
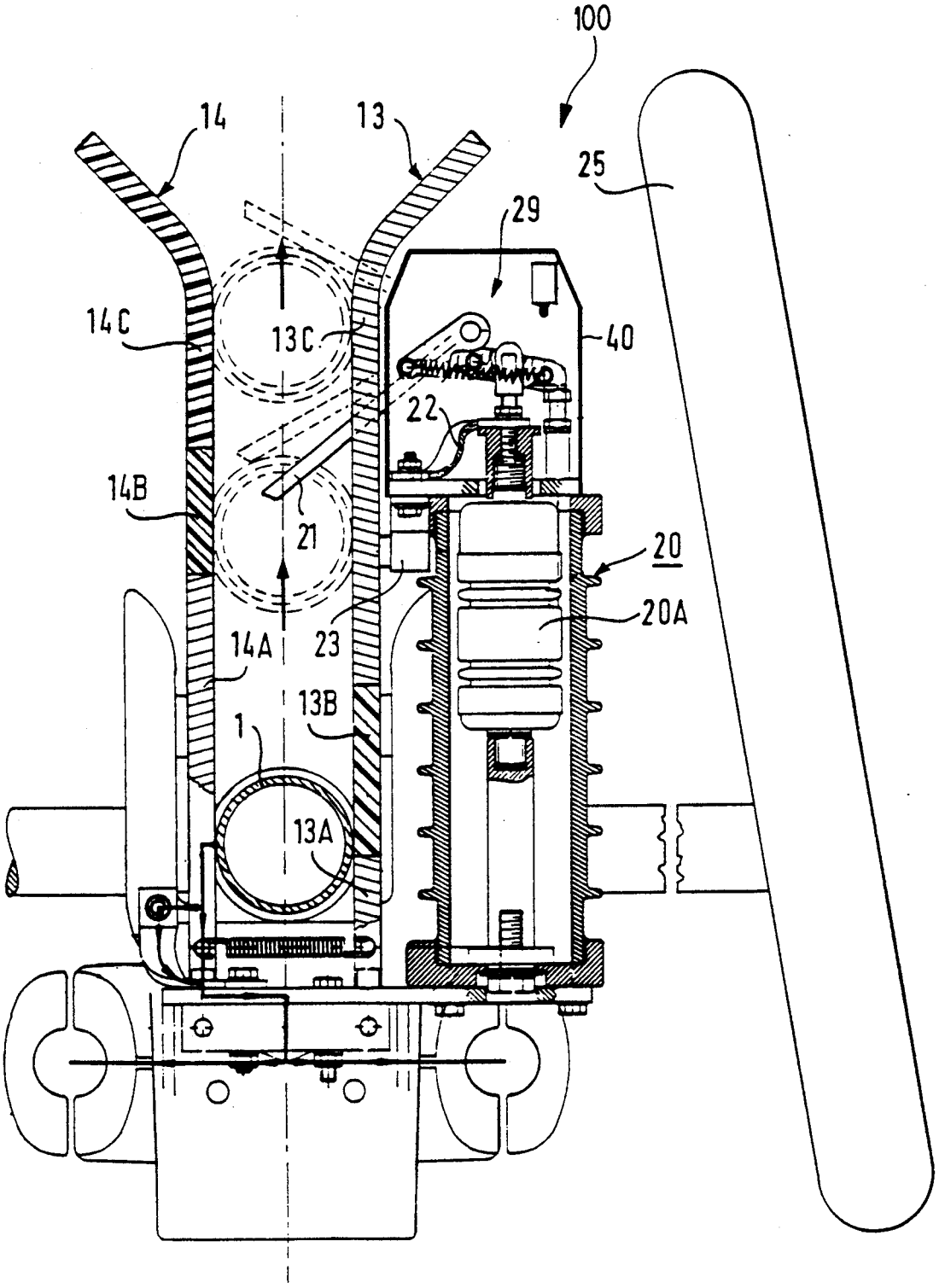
FIG. 3 is an end view of the top of the second column of the section switch.

The section switch operates as follows:

in the closed position (FIGS. 2 and 3) the hammer 10 is in contact with the fingers 9A, and electricity flows via the connector 7, the blade 1, the hammer 10, the fingers 9A, and the connector 8.

At the beginning of an opening operation, the blade 1 rotates through 90° about its own axis, thereby interrupting the flow of current between the hammer and the contact fingers. The cylindrical sacrificial hammer 10A continues to allow electricity to pass by virtue of its contact with the horns 14.

When the blade 1 of the section switch 10 begins to move upwards, the sacrificial hammer 10A is in contact with the insulating portion 13B of the horn 13. Electricity then flows via the connector 7, the blade 1, the hammer 10, the sacrificial hammer 10A, the horn 14, and the connector 8.

When the blade 1 begins its stroke, the sacrificial hammer 10A, after passing through a buffer region where electricity can still flow via the interrupter switch 20 and the parts 14A, 17, 18, and 16, reaches a position where it is in contact with the insulating portion 14B of the horn 14 and with the conducting portion 13C of the horn 13. Electricity then flows via the connector 7, the blade 1, the hammer 10, the sacrificial hammer 10A, the portion 13C of the horn 13, the braid 23, the braid 22, the vacuum switch 20A, the bracket 16, and the connector 8.

As it continues to move upwards, the sacrificial hammer 10A takes the trigger arm 21 with it and the moving trigger arm causes the vacuum switch to open suddenly.

Figure 6:
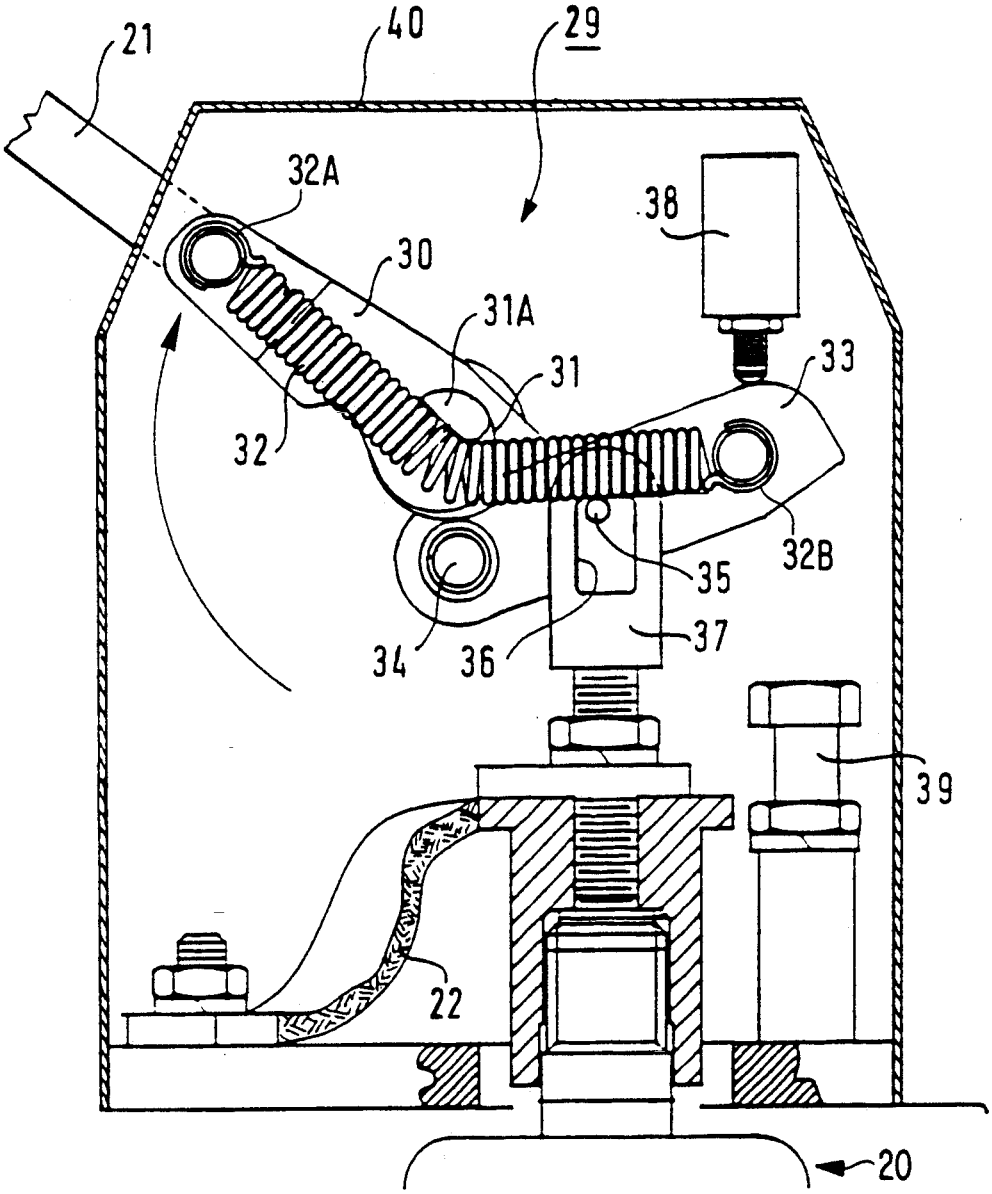

The drive mechanism 29 of the interrupter switch 20 operates as follows:

the lever 30 secured to the arm 21 extends the spring 32 and after going through dead center, FIG. 6 puts the lever 33 into motion. The stud 35 begins by moving along a certain stroke during which the lever 33 acquires a certain amount of kinetic energy, after which the stud 35 strikes the top end of the oblong slot 36 in the part 37 and drives this part over a sufficient stroke to open the interrupter switch 20.

The abutment 39 serves to adjust the distance of travel of lever 33 from abutment 39 distances before the stud 35 strikes the end of the oblong slot 36 in the part 37, and consequently serves to adjust the energy that is accumulated by the equipment. A spacing of 2 mm can thus be achieved in 2 ms.

Since the instantaneous speed depends on the energy, this adjustment has a direct influence on the speed.

The stud 31A, FIG. 6, keeps the spring 32 under tension and prevents the spring 32 from going past the axis 31.

The abutment 23 enables the gap between the contacts in the vacuum switch to be adjusted, e.g. over the range 6 mm to 8 mm.

The above-described device thus makes it possible to adjust the opening speed of the contacts.

One of the advantages of a section switch of the invention stems from the fact that unlike prior art section switches, the interrupter switch drive arm is not used for passing electricity.

If ice is present on the sacrificial hammer 10A, then it impedes obtaining a good contact since the arm is not under sufficient pressure to break the ice, and it is difficult to increase this pressure without hindering opening of the section switch 100 whose drive mechanism is at the opposite end of the blade.

The use of horns 13 and 14 that constitute a clamp requires little mechanical energy for driving the section switch since the penetration force of the hammer into the jaws 9 is perpendicular to the pressure force exerted by the horns 13 and 14 on the sacrificial hammer 10A, and is therefore limited essentially to friction forces.

In the presence of ice, the sacrificial hammer 10A shears through the ice as it moves up or down.

The invention is applicable to high tension section switches, and in particular to section switches that move vertically.

I claim:

1. A section switch of the type comprising: an interrupter switch, a blade connected at a first end to a first connector and to first means enabling said blade during an opening state, firstly to rotate about a blade axis, and secondly to pivot about a transverse axis, said blade including at a second end a contact hammer for co-operating with jaws connected to a second connector, said section switch including second means such that during an opening operation, once said blade has rotated about said blade axis for disconnecting the contact hammer electrically from the jaws, electricity is initially diverted through and is subsequently switched by said interrupter switch, said section switch including a sudden break drive mechanism operable to open said interrupting switch under control of said sudden break drive mechanism by displacement of said blade, wherein said first means comprise a sacrificial hammer removably disposed to extend the contact hammer and co-operating with first and second horns, between which said sacrificial hammer engages and moves with friction, said first horn having an insulating portion between two metal portions to opposite ends thereof, one metal portion being connected to a second connector and the other metal portion being connected to one of the inlets of the interrupter switch, said second horn having an insulating portion and a metal portion, said metal portion of said second horn being connected to the second connector, said sacrificial hammer being suitable, during a section switch opening operation, for moving an arm that controls the operation of the sudden break drive mechanism for operating the interrupter switch, and the respective insulating portions of the horns being offset to enable current to be switched from the sacrificial hammer to the interrupter switch, with a second terminal thereof being connected to the second connector.

2. A section switch according to claim 1, wherein the sudden break drive mechanism for operating the interrupter switch comprises a first lever, means for pivoting said first lever, under drive from the arm, about a fixed axis disposed at a first end of said first lever, a spring fixed firstly to the second end of said first lever and secondly to a first end of a second lever, means pivotally mounting said second lever about a fixed axis at a second end of said second lever, and said second lever carrying a stud engaged in an oblong slot in a part connected to a moving contact of the interrupter switch.

3. A section switch according to claim 2, wherein the sudden break drive mechanism includes first and second abutments limiting the stroke of said second lever.

4. A section switch according to claim 2, wherein the axis of the first lever includes a stud projecting in the path of the spring for preventing the spring from passing beyond said axis during pivoting of said second lever between said first and second abutments.

5. A section switch according to claim 3, wherein the axis of the first lever includes a stud projecting into the path of the spring for preventing the spring from passing beyond said axis during pivoting of said second lever between said first and second abutments.

* * * * *